US005541029A

United States Patent [19]

Iwata et al.

[11] Patent Number: 5,541,029

[45] Date of Patent: Jul. 30, 1996

[54] MULTICOLOR IMAGE FORMING METHOD PREVENTING MIXING OF COLORS

[75] Inventors: Naoki Iwata, Tokyo; Tomotoshi Nakahara, Yokohama; Hisao Murayama, Kawasaki; Ichiro Komuro, Yokohama, all of Japan

[73] Assignee: Ricoh Company, Ltd., Tokyo, Japan

[21] Appl. No.: 302,466

[22] Filed: Sep. 12, 1994

Related U.S. Application Data

[63] Continuation of Ser. No. 904,016, Jun. 25, 1992, abandoned.

[30] Foreign Application Priority Data

| | | | |
|---|---|---|---|
| Jun. 25, 1991 | [JP] | Japan | 3-153517 |
| Jul. 22, 1991 | [JP] | Japan | 3-181177 |
| Sep. 2, 1991 | [JP] | Japan | 3-248325 |

[51] Int. Cl.[6] ..... G03G 13/01

[52] U.S. Cl. ..... 430/45; 430/42; 430/30

[58] Field of Search ..... 430/45, 42, 30

[56] References Cited

U.S. PATENT DOCUMENTS

| | | | |
|---|---|---|---|
| 4,686,163 | 8/1987 | Ng et al. | 430/42 |
| 4,733,267 | 3/1988 | Enoki et al. | 355/3 |
| 4,833,505 | 5/1989 | Furuya et al. | 430/42 |
| 4,885,223 | 12/1989 | Enoki et al. | 430/122 |
| 4,922,301 | 5/1990 | Katoh et al. | 355/251 |
| 4,935,782 | 6/1990 | Kohyama | 430/110 |
| 4,984,026 | 1/1991 | Nishise et al. | 430/126 |
| 4,989,043 | 1/1991 | Suzuki et al. | 355/246 |
| 5,030,996 | 7/1991 | Tajima et al. | 355/246 |
| 5,219,697 | 6/1993 | Mori et al. | 430/110 |

*Primary Examiner*—George F. Lesmes
*Assistant Examiner*—Laura Weiner
*Attorney, Agent, or Firm*—Oblon, Spivak, McClelland, Maier & Neustadt, P.C.

[57] ABSTRACT

A multicolor image forming method of the kind sequentially developing a plurality of latent images formed on an image carrier by toners of respective colors and transferring the resulting toner images to a recording medium at the same time. Development in the second color and successive colors is implemented as noncontact type development using a thin layer of nonmagnetic toner. This toner layer satisfies a condition of $dt/\epsilon t<590(\mu m)^2$ where dt and $\epsilon t$ are respectively the thickness and the average volume specific inductive capacity of the layer. The toner for the development in the second color and successive colors is produced by polymerization and has an average volume particle size of 10 μm or less. Development in the first color is implemented by a toner having a relatively sharp particle size distribution, not including relatively large particles, having a sharp charge amount distribution, and not producing particles of low charges. The toner for the development in the first color has a smaller average particle size than the toner for the development in the second and successive colors.

9 Claims, 14 Drawing Sheets

PRIMARY CHARGE

PRIMARY EXPOSURE

PRIMARY DEVELOPMENT

SECONDARY CHARGE (RECHARGE)

SECONDARY EXPOSURE

SECONDARY DEVELOPMENT

PRIMARY CHARGE

PRIMARY EXPOSURE

PRIMARY DEVELOPMENT

SECONDARY CHARGE (RECHARGE)

SECONDARY EXPOSURE

SECONDARY DEVELOPMENT

MULTICOLOR IMAGE FORMING METHOD PREVENTING MIXING OF COLORS

This application is a Continuation of application Ser. No. 07/904,016, filed on Jun. 26, 1992, now abandoned.

BACKGROUND OF THE INVENTION

The present invention relates to a multicolor image forming method of the kind sequentially developing a plurality of latent images electrostatically formed on an image carrier by toners of respective colors and transferring the resulting toner images to a recording medium at the same time. More particularly, the present invention is concerned with a bicolor image forming method which transfers toner images formed on the image carrier in two colors to a recording medium at the same time.

A bicolor image forming method is extensively practiced with a copier, facsimile transceiver, printer or similar apparatus. The method consists in forming a toner image of first color on an image carrier by first charging, exposure and development, forming a second toner image on the image carrier by second charging, exposure and development while holding the toner image of first color, and transferring the toner images of first and second colors to a recording medium at the same time. Usually, the toner image of second color is formed by a noncontact type developing unit, i.e., a developing unit having a developing roller spaced apart from the image carrier and using a nonmagnetic toner, so that it may not disturb the toner image of first color existing on the image carrier, as disclosed in, for example, Japanese Patent Laid-Open Publication Nos. 60471/1988, 63061/1988, and 85578/1988. The problem with the conventional method is that when a bicolor image forming procedure is repeated over a long period of time, the toner image of second color becomes impure and thereby degrades image quality. This stems from the fact that the toner forming the toner image of first color on the image carrier unexpectedly flies into the developing unit storing the toner image of second color when of forming the toner image of second color.

Bicolor image forming methods elaborated to eliminate the above problem are disclosed in Japanese Patent Laid-Open Publication Nos. 7252/1986, 294579/1988, 294580/1988 and 123069/1988 as well as in Japanese Patent Publication No. 45916/1989. None of them, however, can ensure stable bicolor toner images over a long period of time.

On the other hand, Japanese Patent Laid-Open Publication No. 48683/1990 proposes a bicolor image forming method of the type forming toner images of first and second colors on an image carrier by toners of first and second colors which are opposite in polarity to each other, uniformizing the polarity by a pretransfer charger, transferring the toner images at the same time, and removing the toners remaining on the image carrier after the image transfer. Although this type of method enhances the cleaning efficiency, it has various problems left unsolved, as follows. The charging effected by the precharger increases the charge potential of the toner of the same polarity as the charging, i.e., lowers the charge potential of the other toner of the opposite polarity relative to the former. As a result, the two toner images are charged in different amounts at the time of simultaneous transfer. It follows that although one of the two toners may be efficiently transferred to a recording medium, the other toner is transferred only defectively or with an undesirably enhanced edge effect. In this situation, it is difficult to set up an adequate potential for transferring the two toner images at the same time and, therefore, to provide images with constant density. Regarding the cleaning step, despite that the pretransfer charger lowers the potential, the toner of the same polarity as the pretransfer charge carries a great amount of charge and, therefore, constitutes a heavy load. Such a load is apt to effect the removal of the remaining toner to be performed by, for example, a blade or a brush. Moreover, this kind of image forming procedure is not practicable without resorting to a bulky, complicated and, therefore, expensive apparatus.

SUMMARY OF THE INVENTION

It is therefore an object of the present invention to provide a multicolor image forming method capable of insuring a clear-cut and pure multicolor image over a long period of time.

It is another object of the present invention to provide a bicolor image forming method capable of forming a clear-cut and pure bicolor image over a long period of time.

It is another object of the present invention to provide a bicolor image forming method of the type forming a bicolor image by use of toners of the same polarity and capable of easily removing the toners which remain after image transfer.

In accordance with the present invention, in a bicolor image forming method comprising the steps of developing a first latent image electrostatically formed on an image carrier by a toner of first color stored in a first developing unit to thereby produce a toner image of first color, developing a second latent image electrostatically formed on the image carrier by a nonmagentic one-component toner of second color stored in a noncontact type second developing unit to thereby produce a toner image of second color, and transferring the first and second toner images to a recording medium, the toner of second color is deposited on a developer carrier of the second developing unit in a layer satisfying a relation:

$$\frac{dt^2}{\epsilon t} < 590\ (\mu m)^2$$

where dt is a thickness of the layer, and $\epsilon t$ is an average volume specific inductive capacity of the layer In accordance with the present invention, in a bicolor image forming method comprising the above steps, the toner of first color comprises a toner having a ratio of average volume particle size Dv to average number particle size Dp which is greater than or equal to 1.00 and smaller than or equal to 1.20, and the average volume particle size Dv greater than or equal to 1.0 μm and smaller than or equal to 10.0 μm.

In accordance with the present invention, in a bicolor image forming method comprising the above steps, the toner of first color forming the first toner image on the image carrier has an amount of charge per unit weight which is at least twice as great as an amount of charge per unit weight of the toner of second color deposited on a developer carrier of the second developing unit, as measured before the formation of the toner image of second color.

In accordance with the present invention, in a bicolor image forming method comprising the above steps, the toner of second color contains hydrophobic $SiO_2$ in a greater amount than the toner of first color.

In accordance with the present invention, in a bicolor image forming method comprising the above steps, the toner of first color has a smaller average particle size than the toner of second color and has a ratio of average volume particle size Dv1 and average number particle size Dp1 which is smaller than or equal to 1.2.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a conventional multicolor image forming method, particularly bicolor forming method, will be described first.

Figure 1A:
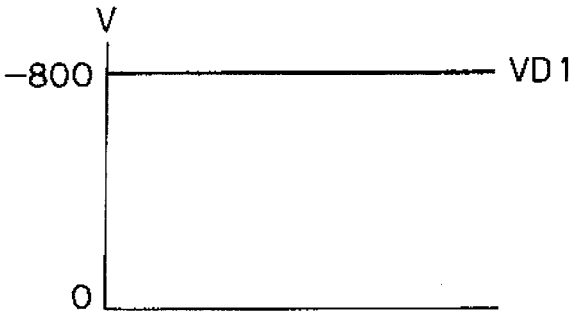
Fig. 1A PRIOR ART
FIGS. 1A–1F demonstrate a general sequence of steps available for the formation of a bicolor image.
Figure 1B:
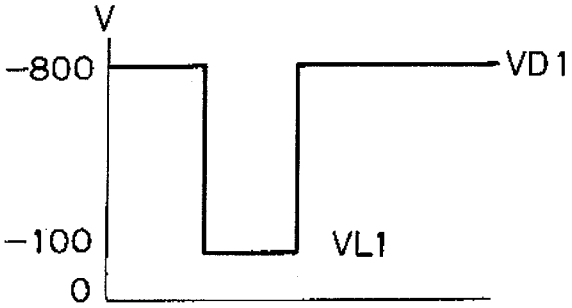
Fig. 1B PRIOR ART
Figure 1C:
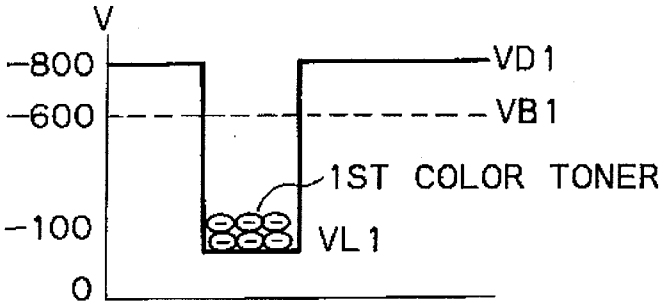
Fig. 1C PRIOR ART
Figure 1D:
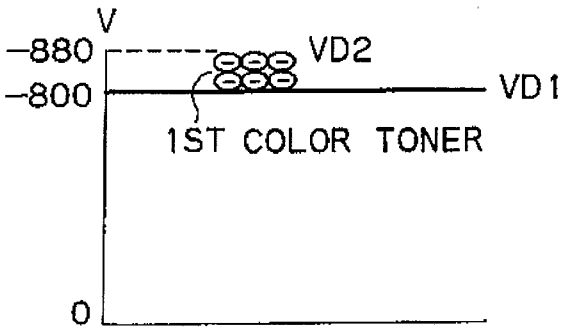
Fig. 1D PRIOR ART
Figure 1E:
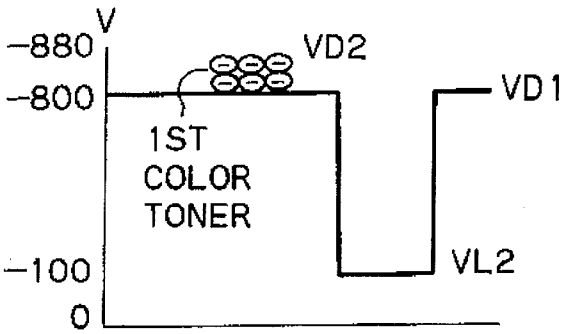
Fig. 1E PRIOR ART

A conventional bicolor image forming method begins with a primary charging (FIG. 1A) which uniformly charges the surface of an image carrier to, for example, a negative potential VD1 (=–800 V). The primary charging is followed by a primary exposure (FIG. 1B) which exposes the charged surface of the image carrier by image data corresponding to a toner image of first color, thereby forming a first latent image whose potential is VL1 (=–100 V). Then, in primary development (FIG. 1C), the first latent image is developed by a toner having a negative charge and under the application of a bias voltage VB1 (=–600 V), whereby the toner image of first color is formed. In the subsequent secondary charging or recharging (FIG. 1D), the image carrier is charged again to a uniform potential VD2 (=–880 V) while holding the toner imge of first color. The image carrier so recharged together with the toner image of first color is exposed by image data corresponding to a toner image of second color by a secondary exposure (FIG. 1E), whereby a second latent image whose potential is VL2 (=–100 V) is formed. The method ends with secondary development (FIG. 1F) which forms the toner image of second color by developing the second latent image by a toner having a charge of the same polarity as the charge deposited on the image carrier and by applying a bias voltage VB2 (=–700 V). The primary and secondary development mentioned above are generally referred to as reversal development. The toner images of first and second colors formed on the image carrier one above the other are transferred to a paper sheet or similar recording medium at the same time and then fixed.

Figure 1F:
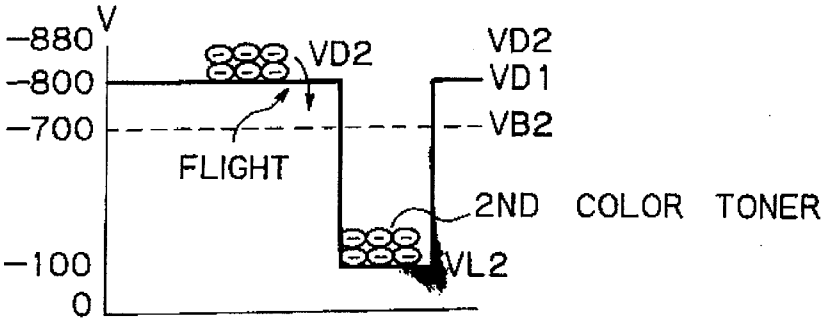
Fig. 1F PRIOR ART

The problem with the conventional bicolor image forming method is that as the above procedure is repeated over a long period of time, toner images of second color become impure to degrade image quality. This stems from the fact that at the time of secondary development the toner forming the toner image of first color is electrically attracted to the second developer and unexpectedly flies by electrostatic force from the image carrier to a developing unit accommodating the second toner and and is mixed with the latter. Specifically, the negatively charged toner of first color is attracted toward the above-mentioned developing unit, i.e., a developing roller or similar developer carrier accommodated therein away from the image carrier due to the difference between the charge potential VD2 of the secondary charging and the bias voltage VB2 of the secondary development (VD2–VB2) as shown in FIG. 1F, (arrow labelled flight). As a result, the toner of first color is mixed with the toner of second color.

By a series of researches and experiments on such accidental flight of the toner of first color, we found the following facts (1)–(5).

(1) Among the particles of the toner of first color, those having comparatively large diameters easily fly.

(2) Particles of the toner of first color bearing comparatively small amounts of charge easily fly.

(3) Particles of the toner of first color whose adhesion to the image carrier is comparatively weak easily fly.

(4) The greater the potential difference (VD2–VB2), the more toner flies.

(5) The smaller the distance between the image carrier and the developer carrier at the time of the secondary development, the more toner flies.

Figure 2:
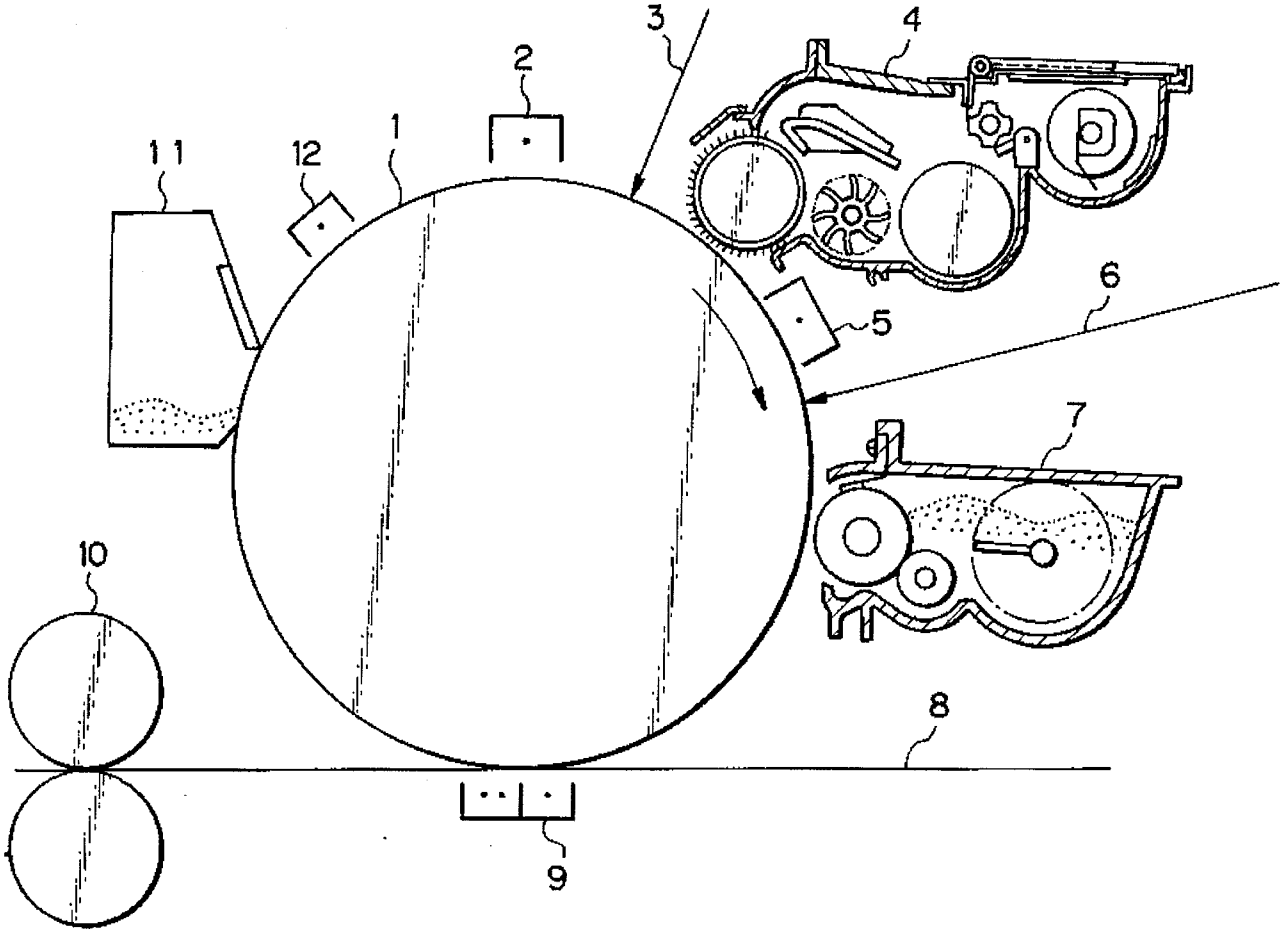
FIG. 2 is a section of an image forming apparatus with which a bicolor image forming method of the present invention is practicable.

Referring to FIG. 2, an image forming apparatus with which the present invention is practicable is shown and implemented as a bicolor image forming apparatus by way of example. As shown, the apparatus has an image carrier implemented as a photoconductive drum 1. Arranged around the drum 1 are a first charger 2 for uniformly charging the surface of the drum 1, a first developing unit 4 for forming a first toner imge on the drum 1, a second charger 5 for recharging the drum 1, a developing unit 7 for forming a second toner image on the drum 1, a cleaning unit 11, and a discharger 12. The cleaning unit 11 and discharger 12 are located on the opposite side to the second developing unit 7 with respect to the drum 1. When the drum 1 is made of a negatively chargeable organic photoconductor, use is made of toners which are also negatively chargeable. The first developing unit 4 may be implemented by contact type or noncontact type developing means, as desired. In this specific construction, the developing unit 4 is implemented with contact type development using a mixture of toner and carrier; the toner is charged by the friction thereof with the carrier and forms a magnet brush together with the latter. For the second developing unit 7, a nonmagnetic toner which is easy to color is feasible and is used in combination with noncontact type development which is practicable with a miniature and incostly arrangement. Scanning beams 3 and 6 from first and second exposing means, respectively, are focused onto the surface of the drum 1. To transport a paper sheet or similar medium, not shown, a belt 8 is pressed against the drum 1 by a transfer charger 9 from the rear thereof. A fixing unit 10 is located downstream of the belt 8 for fixing a toner image on the medium.

In operation, the first charger 2 uniformly charges the surface of the drum 1. The beam 3 scans the charged surface of the drum 1 to electrostatically form a first latent image thereon. The first developing unit 4 develops the first latent image to produce a corresponding toner image of first color. As the drum 1 is rotated in a direction indicated by an arrow in the figure, the second charger 5 recharges the drum 1 from above the first toner image of first color. As a result, the potential condition of the region of the drum 1 undergone the primary exposure becomes substantially the same as the surrounding potential condition. Subsequently, the beam 6 scans the drum 1 to electrostatically form a second latent image. At this instant, if the region of the drum 1 where the toner of first color is deposited is not exposed, the toner of first color and the toner of second color will be prevented from overlapping each other on the drum 1 and, therefrom, from becoming impure. The second developing unit 7 develops the second latent image. Since this development is effected with a DC bias voltage substantially the same as the charge potential of the drum 1, the mixture of colors due to the unexpected flight of the toner of first color is prevented over a long period of time despite the repetitive development. At this instant, the background of the drum 1 is free from contamination only if toner layers for the second and successive development satisfy particular conditions which will be described or if one-component nonmagnetic toners produced by polymerization and having an average volume particle size of 10 μm or less are used. The multicolor image formed on the drum 1 by the above procedure is transferred together to the paper sheet on the belt 8 by the transfer charger 9 and then fixed on the sheet by the fixing unit 10. After the image transfer, toner particles remaining on the drum 1 are removed by the cleaning unit 11. Consequently, the drum 1 is prepared for the next image forming procedure.

Figure 3:
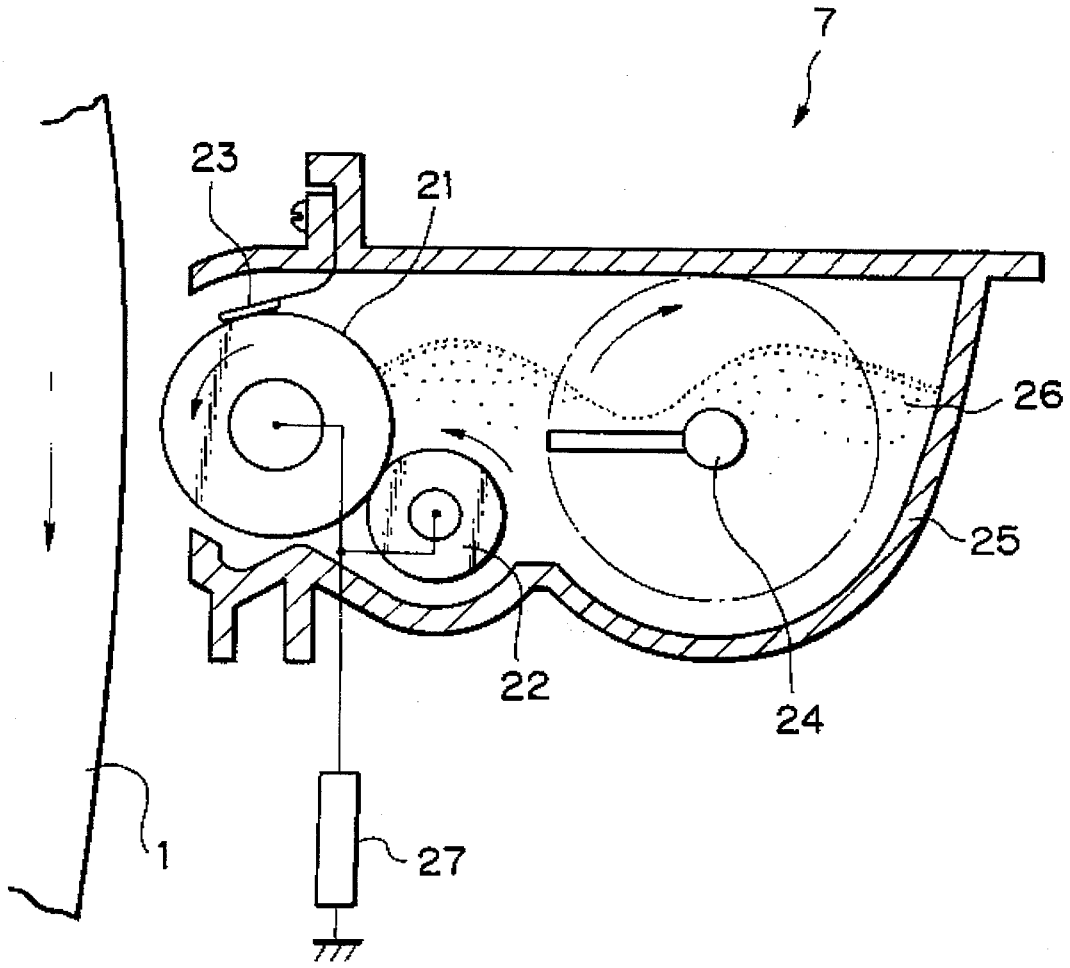
FIG. 3 is a section showing a second developing unit included in the apparatus of FIG. 1 more specifically.

A reference will be made to FIG. 3 for describing the development to be effected by the second developing unit 7 specifically. The developing unit 7 is assumed to use a nonmagnetic one-component toner. As shown, a toner 26 different in color from the toner of first color is supplemented to a hopper 25 and then agitated by an agitator 24. The toner conveyed to a supply member 22 is supplied to a developing roller 21 in frictional contact with the roller 21. A layer forming member 23 regulates the thickness of the toner deposited on the developing roller 21, whereby an even toner layer is transported to a predetermined developing region. Preferably, the toner is deposited on the developing roller 21 in an amount which ensures sufficient image density even when the roller 21 and the drum 1 are moved at substantially the same speed while facing each other and without contacting each other. Should the speeds of the developing roller 21 and drum 1 be different, a phenomenon generally referred to as "toner rear offset" would occur to render the density of a solid image irregular to thereby degrade the quality of a color image. To eliminate this phenomenon, it is necessary to transport the toner in two or three layers to the developing region. This can be done if the developing roller 21 is provided with an aluminum surface undergone sand blasting or implemented as an aluminum roller having minute grooves in which a dielectric substance is confined.

The prerequisite with the development in the second color is that it does not disturb the toner image of first color existing on the drum 1. To meet this requirement, it is preferable that the developing roller 21 and the drum 1 be spaced apart by 0.05 mm to 0.5 mm, desirably 0.1 mm to 0.2 mm. Distances smaller than 0.05 mm are apt to cause the toner layers of first and second colors to contact each other. On the other hand, distances greater than 0.5 mm would obstruct the expected flight of the toner of second color since the line portions of the latent image would form closed electric fields, i.e., no electric fields for development would be generated between the roller 21 and the drum 1. In the event of development, a bias voltage for development is applied from a power source 27 to the developing roller 21. By the recharging effected by the second charger 5 after the primary development in the first color, the potential of the toner image of first color is made about 50 V to 100 V higher than the surrounding area due to the charge of the toner itself. Assuming that potential of the region for writing an image in the second color is −100 V while the background potential is −800 V, then the region carrying the toner image of first color has a potential of −850 V to −900 V. The bias voltage for development should be so selected as to prevent the toner of first color from flying into the developing unit 7 by accident with no regard to the elapse of time, to allow the nonmagntic toner layer to desirably fly toward the latent image of second color, and to prevent the toners from depositing on the background of the drum 1. For example, in the procedure shown in FIGS. 1A–1F, since the bias voltage VB2 for the second color is about −700 V (FIG. 1F), 100 V which is the difference between the background potential VD1 (=−800 V) and the voltage VB2 is needed as a bias voltage to protect against the background contamination. However, since the difference between the bias voltage VB2 (=−700 V) and the surface potential of the toner layer (=−380 V) is greater than 150 V, the toner of first color will easily fly by electrostatic attraction toward the developing unit 7 when the amount of charge thereof decreases or the amount of deposition thereof increases due to aging or varying ambient conditions.

Figure 4A:
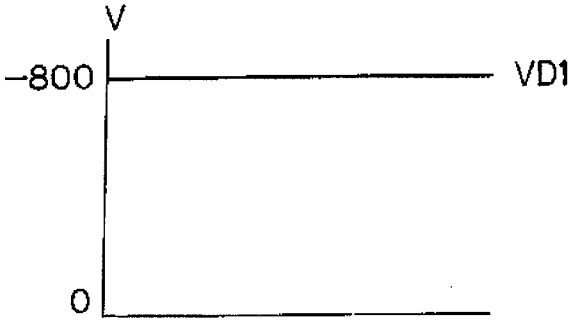
FIGS. 4A–4F show a bias voltage which the method of the present invention applies for secondary development.
Figure 4B:
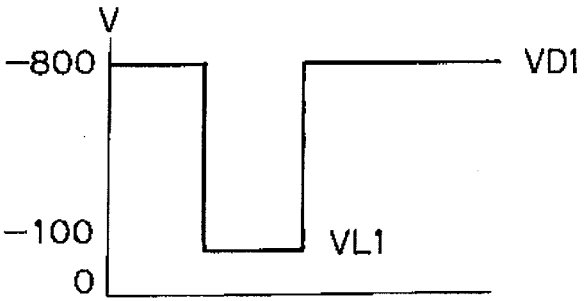
Figure 4C:
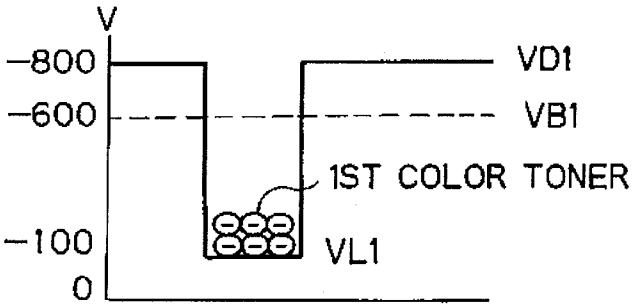
Figure 4D:
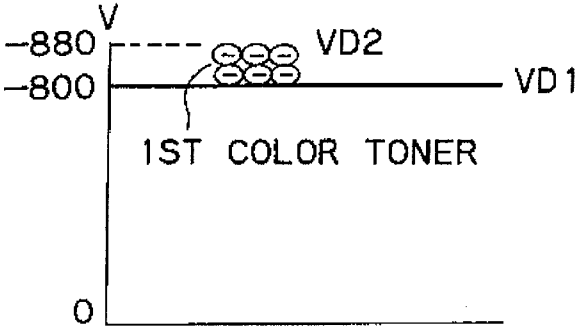
Figure 4E:
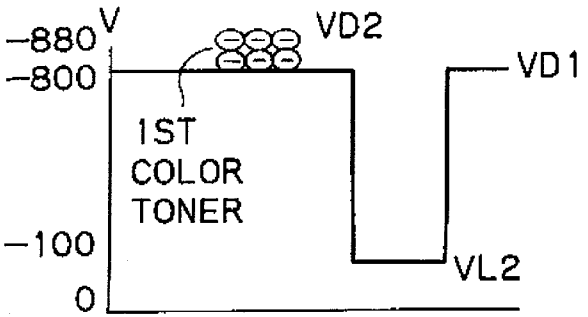
Figure 4F:
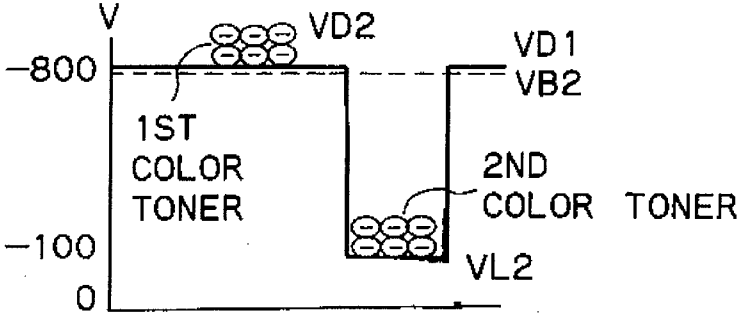

In the light of the above, as shown in FIGS. 4A–4F, the bias voltage VB2 for the development in the second color, i.e., secondary development is selected to be approximately −800 V which is the bias background potential VD1 (FIG. 4F). As a result, the potential difference which would cause the toner of first color to fly is maintained smaller than 100 V at all times. This, coupled with the gap for development, (0.05 mm to 0.5 mm), eliminates the mixture of toners of first and second colors even when the development in the second color is effected by aging or varying environment, i.e., with no regard to the deposition condition of the toner of first color. Moreover, since the potential difference for development, i.e., the difference between the bias voltage and the potential of the writing region is about 700 V, the image is further stabilized despite the development relying on DC electric field and flight.

Figure 5:
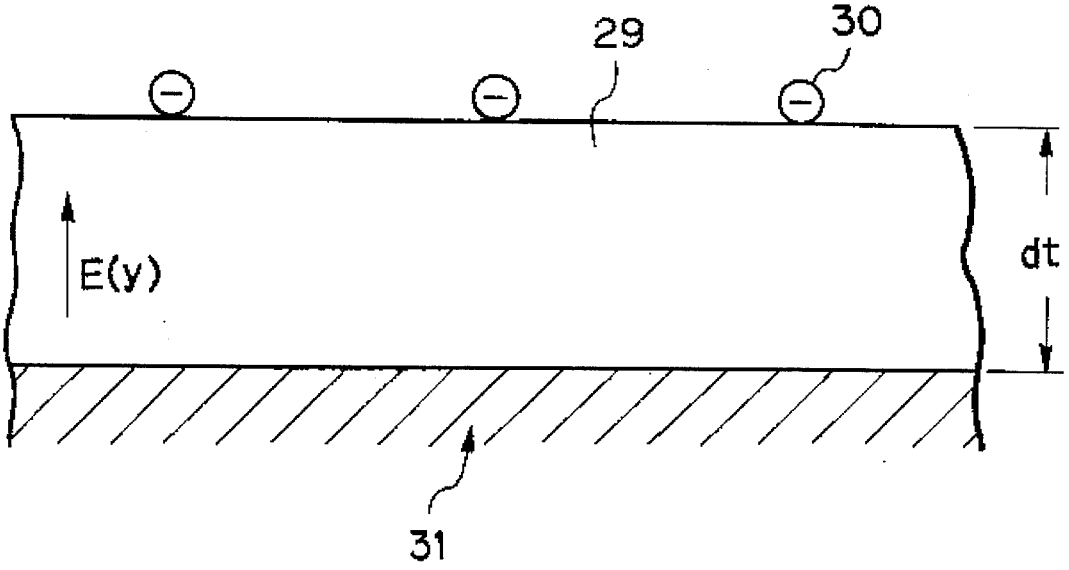
FIG. 5 schematically shows a toner layer formed on a developing roller.

The procedure shown in FIGS. 4A–4F successful in eliminating background contamination will be described specifically. FIG. 5 schematically shows a toner layer 29 together with a metallic sleeve 31 and toner particles 30 contaminating the background. As shown in FIG. 5, assume that the electric field has an intensity E(y) as measured in the vertical direction, that the toner layer 29 has an average volume dielectric constant $\epsilon t$ and an average volume charge amount $\rho$, that a mirror image charge induced on the surface of the developing roller is $\sigma$ per unit area, and that the toner layer 29 has a thickness dt. Then, the increase in surface potential ascribable to the nonmagnetic toner layer for the development in second color or successive color is produced as follows:

$$\text{inside toner layer} \quad \frac{dE}{dy} = \frac{\rho}{\epsilon t \epsilon_0} \tag{1}$$

$$\text{boundary condition} \quad E(0) = \frac{\rho}{\epsilon t \epsilon_0} \tag{2}$$

$$\text{charge preservation rule} \quad \rho dt + \sigma = 0 \tag{3}$$

From the equations (1), (2) and (3), $$E(y) = \frac{\rho}{\epsilon_0 \epsilon t}(y - dt) \tag{4}$$

Therefore, the potential V on the surface of the toner layer is expressed as:

$$V = -\int_0^{dt} E(y)\, dt = \frac{\rho}{2\epsilon_0 \epsilon t}\, dy \tag{5}$$

The smaller the increase in potential stated above, the more the prevention of background contamination by the toner deposited on the surface layer of the developing roller 21 and having low charge is promoted. On the other hand, during development, the greater the amount of charge deposited on the toner, the more clear-cut the image is and the stronger the adhesion force to the developing roller 21 is suppressing background contamination. The amount of charge per unit mass (Q/M) deposited on the toner layer is greater than 5 μC/g, preferably greater than 10 μC/g. The amount of charge of Q/M was measured by a so-called suction method, i.e., by sucking about 10 mg of toner to an about 30 g Faraday gauge. The amount of deposition should be great enough to ensure sufficient density even when the drum 1 and developing roller 21 are driven substantially at the same speed, i.e., that the toner should be deposited in two or three layers. The amount of toner deposition per unit volume (M/V) is represented by the bulk specific gravity of a toner to be used. Generally, an amorphous toner whose average volume particle size is 11 μm has a bulk specific gravity of about 0.3, and the usable range is usually above 0.3. It follows that the range of the average volume charge amount $\sigma$ of the toner layer is produced by:

$$Q/M > 5(\mu C/g) \tag{6}$$

$$M/V > 0.3(g/cm^3) \tag{7}$$

From the equations (6) and (7), $$\rho = Q/V > 1.5(C/cm^3) \tag{8}$$

The increase in voltage V should be less than 50 V in order that the particles in the toner layer having small amounts of charge may not deposit on the background of the drum 1. Hence, the following relation is derived:

$$V = \frac{\rho}{2\epsilon_0 \epsilon t}\, dt^2 < 50 \tag{9}$$

Therefore, $$\frac{dt^2}{\epsilon t} < \frac{2\epsilon_0}{\rho}\, 50 \tag{10}$$

From the equations (8) and (10) and $\epsilon_0 = 8.85 \times 10^{12}$ (C/V·m), $$\frac{dt^2}{\epsilon t} < 590\ (\mu m)^2 \tag{11}$$

If the toner is constituted by spherical particles produced by polymerization, it has a greater packing ratio than amorphous particles and has an average volume particle size of 10 μm or less. This kind of toner is, therefore, only about 20 μm thick when piled in two or three layers and satisfies the above relation (11).

Assuming that the toner has a specific inductive capacity $\epsilon$ and that the packing ratio of toner layer is $\alpha$, there holds an equation $\epsilon t = (1-\alpha) + \alpha\epsilon$ (on condition that air has a specific inductive capacity of 1). Further, assuming that the toner has a true specific gravity m (g/cm$^3$) and a bulk specific gravity n (g/cm$^3$), the packing ratio of toner layer is $\alpha = n/m$.

Specific numerical values considering the above condition (11) are as follows.

A first example uses a drum made of organic semiconductor as an image carrier and implements development in black, or first color, with contact development using a magnetic brush. After the drum 1 carrying a black toner image has been recharged, the second latent image is electrostatically formed on the drum 1 by the second scanning beam 6. After the recharge, the black toner exists in a solid image region on the drum 1 in an amount of about 0.8 mg/cm$^2$ while the amount of charge Q/M per unit mass of the toner layer is −25 μC/g. In this condition, the potential on the drum 1 is −880 V in the region where the black toner exists, −800 V in the background, and −100 V in the exposed region. For the development in the second color, use is made of an amorphous toner produced by pulverization and having an average volume particle size of 7 μm; the drum 1 and the developing roller 21 are rotated at the same linear velocity of 120 mm/sec. The developing roller 21 has an aluminum surface undergone sand blasting. The toner layer has an amount of charge Q/M of −18 μC/g and has a thickness dt of 24 μm as measured by a laser length gauge, a specific inductive capacity $\epsilon$ of 3.1, a true specific gravity m of 1.11 g/cm$^3$, and a bulk specific capacity n of 0.42 g/cm$^3$. Hence, the packing ratio a of toner layer is 37.8%. It follows that the toner layer has an average volume specific inductive capacity of 1.8 and an average volume charge amount $\rho$ of 7.6 C/cm$^3$.

The above toner layer satisfies the previous condition (11), i.e.:

$$\frac{dt^2}{\epsilon t} = 320\ (\mu m)^2 < 590\ (\mu m)^2$$

In the above condition, when the developing roller 21 and the drum 1 were spaced apart by 0.12 mm and a bias voltage for development of −800 V was applied, a desirable multicolor image free from background contamination was produced. Even after the production of 5,000 images, the individual colors were found satisfactorily pure.

In a second example, development in the first color is effected under the same conditions as in the first example while development in the second and successive colors is implemented with an amorphous nonmagnetic toner whose average volume particle size is 11 μm. The toner layer has a charge amount per unit mass Q/M of −12 μC/g, a thickness dt of 33 μm as measured by a laser length gauge, a specific inductive capacity $\epsilon$ of 2.7, a true specific gravity of 1.02 g/cm$^3$, and a bulk specific gravity n of 0.31 g/cm$^3$. Hence, the packing ratio $\alpha$ of the toner layer is 30.4%, the average volume specific inductive capacity $\epsilon t$ is 1.5, and $dt^2/\epsilon t$ is 726 $(\mu m)^2$ which does not satisfy the relation (11). Under the above conditions, when the developing roller 21 and the drum 1 were spaced apart by 0.12 mm and a bias voltage for development of −800 V was applied, background contamination occurred. When the bias voltage was lowered to −700 V, the colors were found mixed together after the production of 5,000 multicolor images.

Further, in a third example, development in the first color is effected under the same conditions as in the first example while development in the second and successive colors is effected under the same conditions as in the second example. The toner layer has a charge amount per unit mass Q/M of −9 μC/g, a thickness dt of 32 μm as measured by a laser length gauge, a specific inductive capacity $\epsilon$ of 3.7, a true specific gravity m of 1.05 g/cm$^3$, and a bulk specific gravity n of 0.38 g/cm$^3$. Therefore, the packing ratio $\alpha$ of the toner layer is 36.2%, the average volume specific inductive capacity $\epsilon t$ is 2.0, and $dt^2/\epsilon t$ is 512 (μm)$^2$ which is smaller than 590 (μm)$^2$ and, hence, satisfies the relation (11). When the developing roller 21 and the drum 1 were spaced apart by 0.12 mm and a bias voltage for development of −800 V was applied, a clear-cut image free from background contamination was obtained. Even after the production of 5,000 consecutive images, the clear-cutness was preserved with no color mixture.

In a fourth example, development in the first color was effected under the same conditions as in the first example. Development in the second and successive colors is implemented with a nonmagnetic toner constituted by spherical particles produced by polymerization and having an average volume particle size of 5 μm. The toner layer has a charge amount per unit mass Q/M of −22 μC/g, and a thickness dt of 18 μm as measured by a laser length gauge. The toner has a specific inductive capacity $\epsilon$ of 2.9, a true specific gravity m of 1.13 g/cm$^3$, and a bulk specific gravity n of 0.51 g/cm$^3$. Therefore, the packing ratio $\alpha$ of the toner layer is 45.1%, the average volume specific inductive capacity $\epsilon t$ is 1.9, and $dt^2/\epsilon t$ is 170 (μm)$^2$ which is smaller than 590 (μm)$^2$ and, hence, satisfies the relation (11). Under the above condition, when the developing roller 21 and the drum 1 were spaced apart by 0.12 mm and a bias voltage for development of −800 V was applied, a desirable multicolor image free from background contamination was obtained. Even after the production of 5,000 copies, the image remained clear-cut and pure.

As stated above, in accordance with the present invention, development in the second and successive colors is implemented as noncontact development using a thin layer of nonmagnetic toner. The toner layer for the noncontact development is controlled to satisfy a relation $dr/\epsilon t<590$ (μm)$^2$. This prevents a toner of first color from flying away from an image carrier by accident and eliminates background contamination with no regard to the condition in which the toner of first color is deposited. As a result, a sharp multicolor image is produced in pure colors stably over a long period of time. Further, the nonmagnetic toner implementing the development in the second and successive colors is constituted by particles produced by polymerization and having an average volume particle size of 10 μm or less. Hence, the above relation is satisfied even when the toner is retained in two or three layers on a developing roller, also insuring a clear-cut and pure multicolor image.

Hereinafter will be described the toner of first color implementing the bicolor image forming method of the present invention.

In a first example, the toner of first color was comprised of a negatively chargeable black toner produced by dispersion polymerization and having an average volume particle size Dv of 0.40 μm and an average number particle size Dp of 6.92 μm (Dv/Dp=1.07). The dispersion polymerization is effected as follows. A hydrophilic organic solvent with a high polymeric dispersant dissolved therein is prepared. One, two or more different kinds of vinyl polymers which dissolves in such a solvent but causes the resulting polymer to swell or hardly dissolve in the solvent are added to the solvent to produce resinous particles by polymerization (referred to as resinous particles A hereinfter). The resinous particles A are dispersed in an organic solvent in which it does not dissolve. Before or after the dispersion, a dye is dissolved in the organic solvent to infiltrate into the resinous particles A. Thereafter, the organic solvent is removed to produce the black toner. Regarding a carrier, use was made of ferrite particles having a particle size of 100 μm and each being covered with a 1 μm thick silicone resin layer. The above-mentioned black toner was mixed with the carrier at a rate of 3.0 Wt % to produce a developer. The apparatus shown in FIG. 2 was operated with such a developer. Then, no toner particles unexpectedly flown away from the drum 1, and the charge amount of the toner deposited on the drum 1 just before the secondary development, FIG. 4F, was measured to be −43 μC/g. The charge amount was measured by a conventional steps of illuminating the entire surface of the drum 1 for attenuation, sucking the toner on the drum 1 by a sucker connected to an electrometer and having a filter in a nozzle thereof, and determining a ratio between the total current caused to flow at the time of measurement by the electrometer and the total weight of the toner caught by the filter. Regarding the flight characteristic, the image forming procedure was effected with an empty second developing unit 7 to measure the amount of toner flown into the unit 7 away from the drum 1. The measured amount of toner was used as an evaluation value. The bicolor image formed by the black developer was found clear-cut and pure even after 5,000 consecutive image forming cycles.

A second example is identical with the first example except that it used a negatively chargeable black toner having an average volume particle size Dv of 5.02 μm and an average number particle size Dp of 4.35 μm (Dv/Dv=1.15). This example was also found to cause no toner particles to unexpectedly fly away from the drum 1 and to control the charge amount of the toner on the drum 1 to −65 μC/g. The example maintained the bicolor image clear-cut and pure even after 5,000 consecutive image forming cycles.

A third example is also identical with the first example except that it used a negatively chargeable black toner having an average volume particle size Dv of 12.57 μm and an average number particle size Dp of 7.75 μm (Dv/Dp=1.62). An experiment showed that this example causes 0.1 Wt % of the black toner to fly away from the drum 1 and deposits 23 μC/g of charge on the toner on the drum 1. The toner flown away from the drum 1 was found to include a number of particles whose size was as great as about 20 μm. Presumably, such large toner particles flew due to the small amount of charge. The bicolor image formed by such a toner initially remained sharp, but the red image region became impure soon. After 1,000 image forming cycles, the lightness of the red image area was found too low to serve practical use.

Figure 6A:
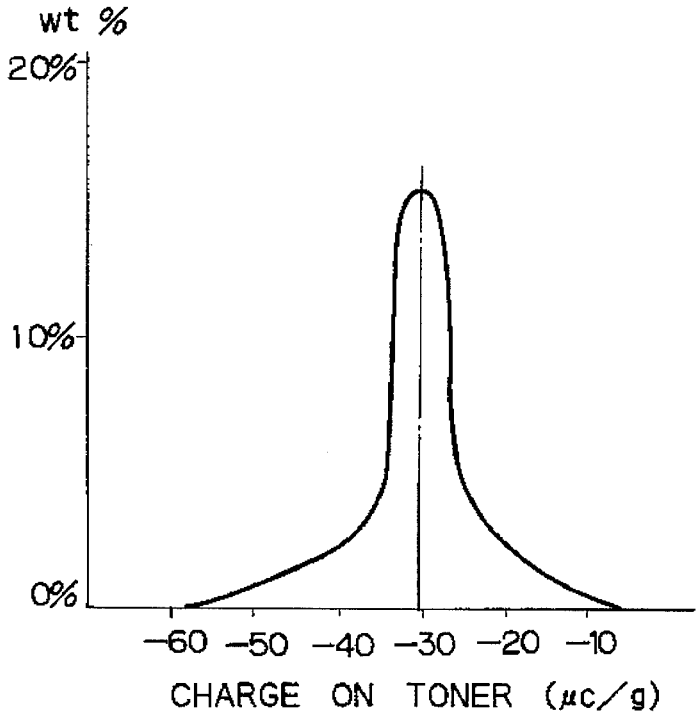
FIGS. 6A and 6B each shows a specific charge amount distribution deposited on a toner.
Figure 6B:
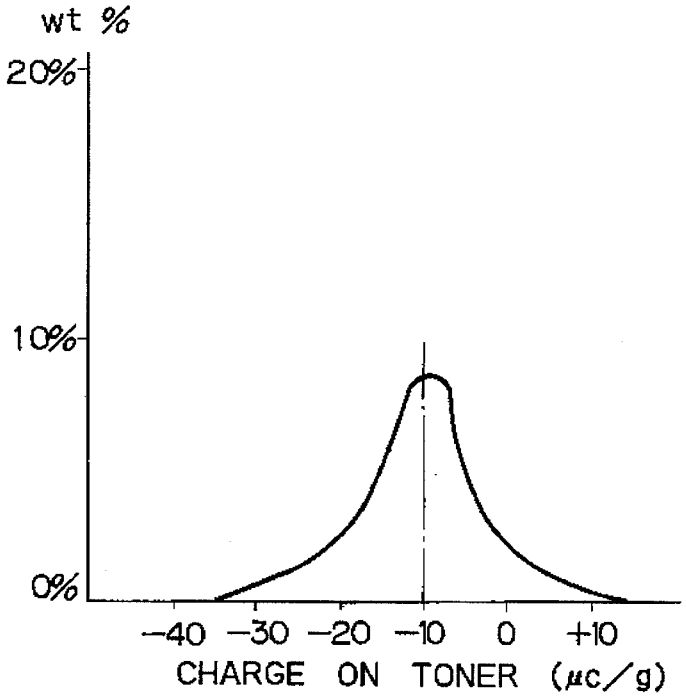

FIG. 6A shows a charge distribution obtained with the developer of the first example while FIG. 6B shows a charge distribution obtained with the developer of the third example. These distributions were measured by E-SPART Analyzer (trade name) available from Hosokawa Micron Co. Ltd. (Japan). As FIGS. 6A and 6B indicate, the first example achieves a sharper charge distribution than the third example.

Figure 7:
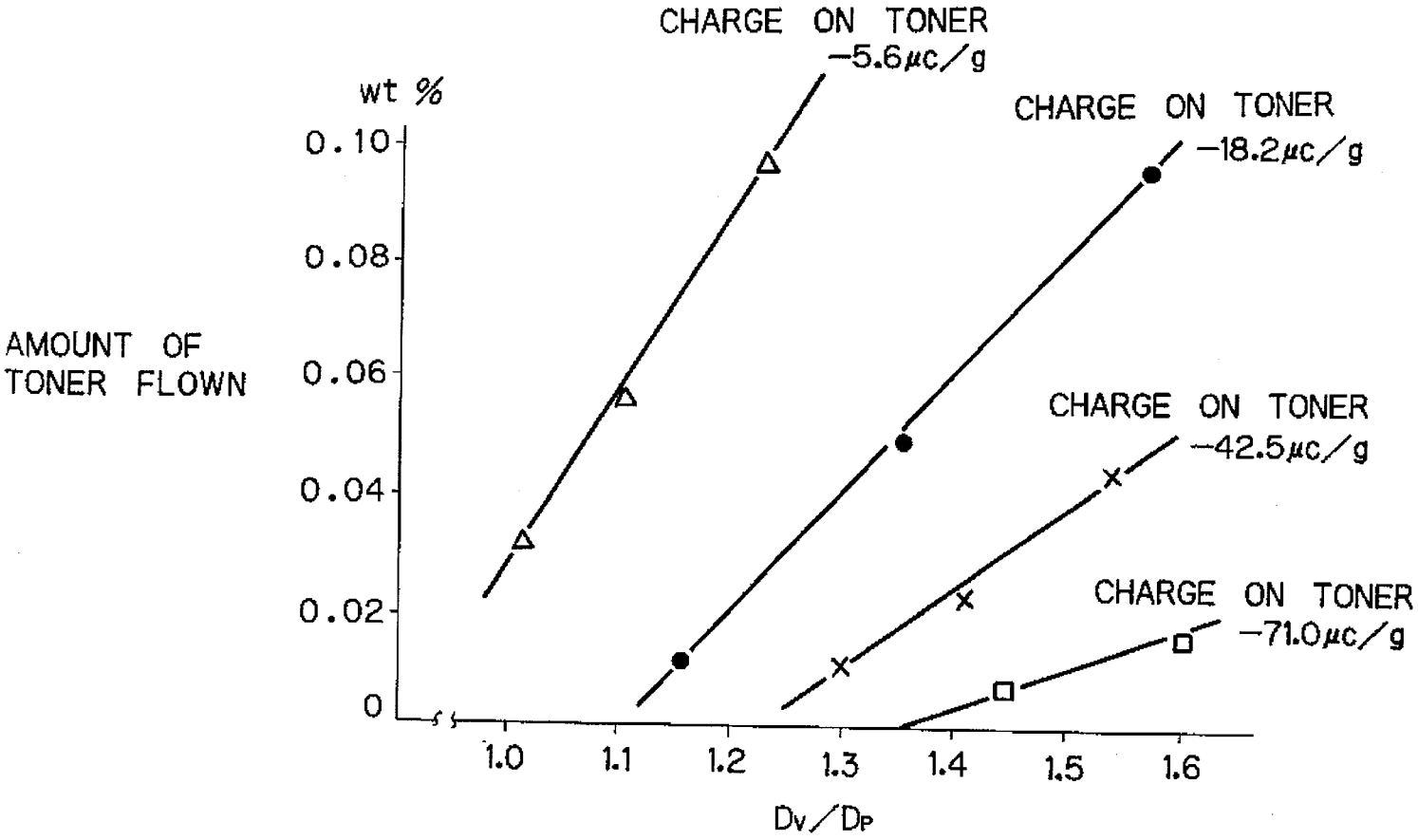
FIG. 7 is a graph showing a relation between the ratio of average volume particle size to average number particle size of a toner and the amount of toner unexpectedly flown away from an image carrier.

FIG. 7 is a graph indicative of a relation of the ratio Dv/Dp of the average volume particle size Dv to the average number particle size Dp and the amount of toner unexpectedly flown away from the drum 1. As shown, when the ratio Dv/Dp is greater than 1.2, the toner flies unless the amount of toner deposited thereon is extremely great. This is presumably because such a great ratio Dv/Dv causes the charge distribution to broaden together with the particle size distribution, producing low charge particles. Should the charge amount of toner be noticeably increased to eliminate the undesirable flight, the resulting image would suffer from low density and other defects due to defective image transfer. Therefore, the ratio Dv/Dp should preferably be smaller than 1.2. Even when the ratio Dv/Dp is smaller than 1.2, the undesirable flight of the toner occurs if the charge amount of the toner is extremely small, since particles with low charges are easy to fly. It is, therefore, preferable to maintain a predetermined amount of charge on the toner.

Figure 8:
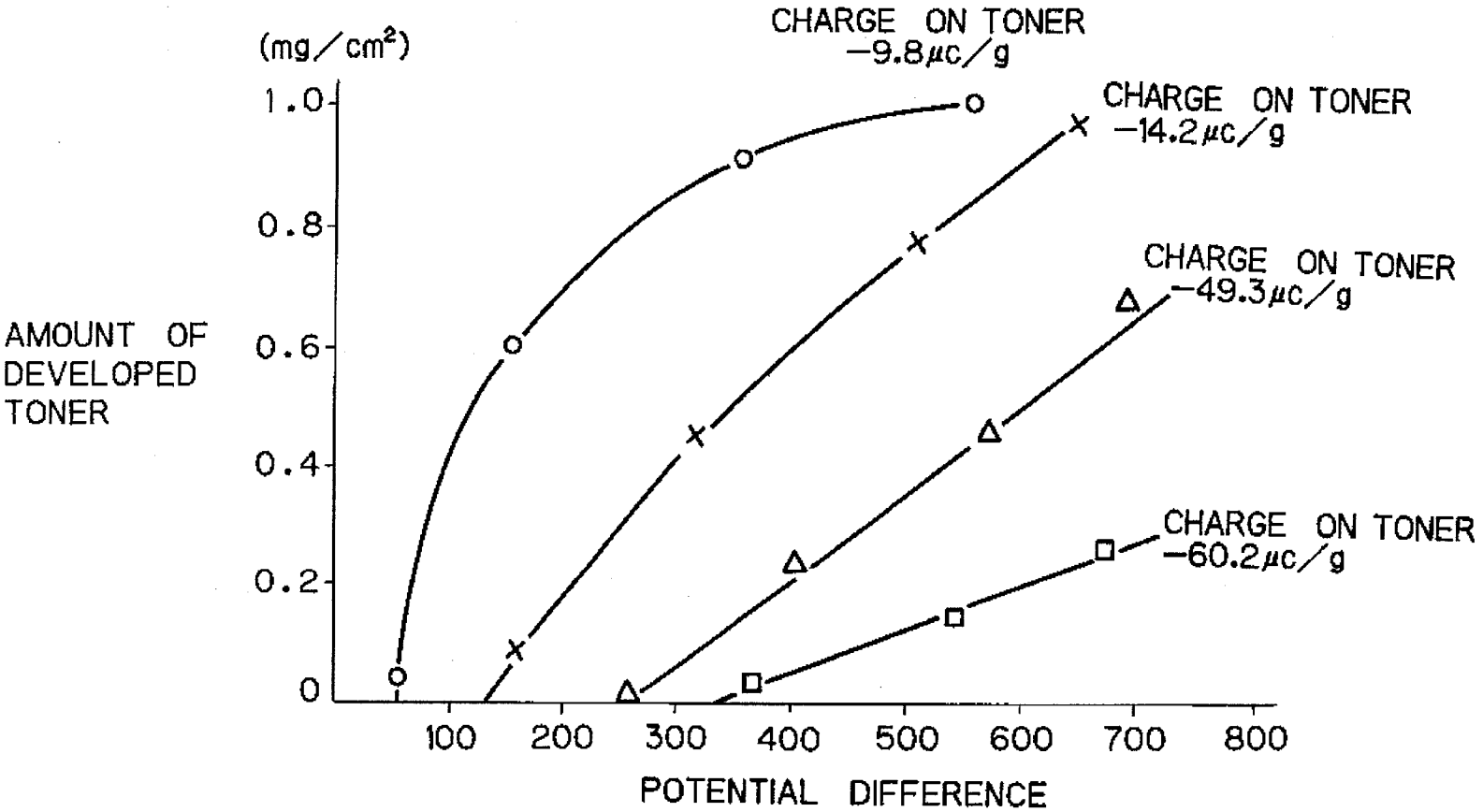
FIG. 8 is a graph indicative of a relation between charge amount of a toner and the developing characteristic.

A fourth example is as follows. In noncontact development, the amount of charge deposited on the toner and the developing characteristic (flight characteristic of the toner) are closely related to each other, as shown in FIG. 8 specifically. In FIG. 8, the abscissa and the ordinate are representative of the potential difference for development and the amount of toner for development, respectively. The amount of charge deposited on the toner is used as a parameter. The relation shown in FIG. 8 has the following tendency although it depends on the gap between the drum 1 and the developing roller and the properties of the toner other than the amount of charge. Specifically, when the amount of charge is small, development begins with a small potential difference and proceeds with a high gradient and in a great amount. Conversely, when the amount of charge is great, development (flight) does not begin unless the potential difference is great and proceeds with a low gradient and in a small amount. Such a tendency is also true with the undesirable flight characteristic. In the light of this, this example used a black toner which was charged in an amount of −23 μC/g and in an amount of 37 μC/g on the drum 1 just before the secondary development as a developer of first color, and a red toner which was charged in an amount of −12 μC/g on the developing roller as a toner of second color. Here, the amount of charge deposited on the black toner on the drum 1 and the amount of charge deposited on the red toner on the developing roller just before the secondary development is in a ratio of (−37)/(−12)=3.08. When the drum 1 and the developing roller of the second developing unit 7 were spaced apart by 180 μm, a desirable bicolor image was obtained over a long period of time.

Figure 9:
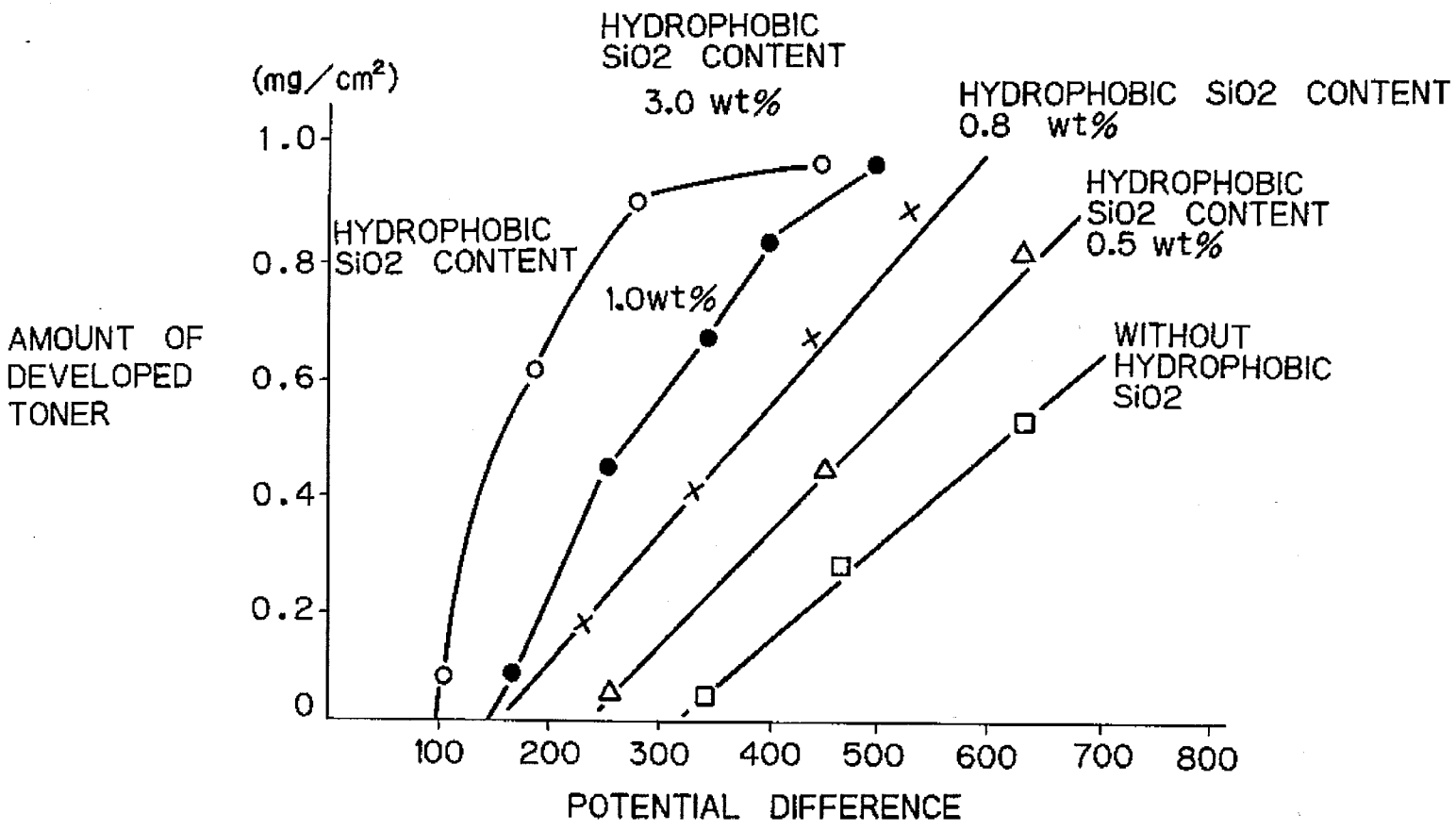
FIG. 9 is a graph showing a relation between the hydrophobic $SiO_2$ content and the developing characteristic.

A fifth example will be described hereinafter. When hydrophobic $SiO_2$ is added to a toner, the amount of hydrophobic $SiO_2$ (Wt %) and the developing characteristic (flight of the toner) are also closely related to each other, as shown in FIG. 9 specifically. In FIG. 9, the abscissa and the ordinate are representative of the potential difference for development and the amount of toner contributed to development, respectively. The amount of hydrophobic $SiO_2$ (Wt %) contained in the toner is used as a parameter. As shown, as the amount of hydrophobic $SiO_2$ increases, the amount of development increases allowing a greater amount of toner to fly. Such a tendency is also true with the undesirable flight characteristic. Taking account of this tendency, this example added a greater amount of hydrophobic $SiO_2$ to the toner of second color than to the toner of first color, allowing the former to fly more easily than the latter. Specifically, use was made of at black toner containing 0.5 Wt % of hydrophobic $SiO_2$ R-972 (trade name) available from Nihon Aerogil Co. Ltd. (Japan) as the toner of first color, and a red toner contaning 1.0 Wt % of the same hydrophobic $SiO_2$ as the toner of second color. The two kinds of toner both were charged in an amount of about −15 μC/g. When the drum 1 and the developing roller of the second developing unit 7 was spaced apart by 200 μm, this example insured a desirable bicolor image over a long period of time.

In summary, the bicolor image forming method of the present invention uses a toner of first color which has a relatively sharp particle size distribution, includes no particles of relatively large sizes, has a sharp charge distribution, and does not include particles which would be charged in small amounts. Since such a toner is prevented from unexpectedly flying away from an image carrier, a pure and clear-cut bicolor image is achievable over a long period of time. The toner of first color is not scattered around due to the sharp charge distribution and the absence of particles which would be charged in small amounts, insuring sharp bicolor images. Further, the amount of charge per unit weight deposited on the toner of first color as measured on the image carrier before the formation of a toner image of second color is more than twice as great as the amount of charge deposited on the toner of second color as measured on the developer carrier. This is successful in causing the toner of first color to adhere comparatively strongly to the image carrier at the time of secondary development. As a result, the undesirable flight of the toner of first color is eliminated to insure a pure and clear-cut bicolor image over a long period of time. Moreover, the toner of first color is provided with a smaller hydrophobic $SiO_2$ content than the toner of second color and, therefore, less easy to fly than the latter. The toner of first color with such a hydrophobic $SiO_2$ content does not fly away from the image carrier when subjected to a bias for development just enough for the toner of second color to fly. This also insures a clear-cut and pure bicolor image over a long period of time.

On the other hand, in accordance with the present invention, the toner of first color stored in the first developing unit has a smaller average particle size than the toner of second color stored in the second developing unit. Specifically, the toner of first color has an average particle size of 5–7.5 μm and has a particle size distribution which satisfies a ratio of average volume particle size to average number particle size which is smaller than or equal to 1.2. Since the toner of first color has such an average particle size smaller than that of the toner of second color, the former has a greater surface area (specific surface area) per unit mass than the latter. As a result, the toner of first color contacts a carrier over a greater area than the toner of second color on condition that the toner concentration is the same, thereby achieving a greater amount of charge than the latter. The toner of first color, therefore, strongly adheres to the image carrier, and once deposited on the image carrier it is prevented from flying toward the second developing unit despite the bias voltage for secondary or noncontact development.

Figure 10A:
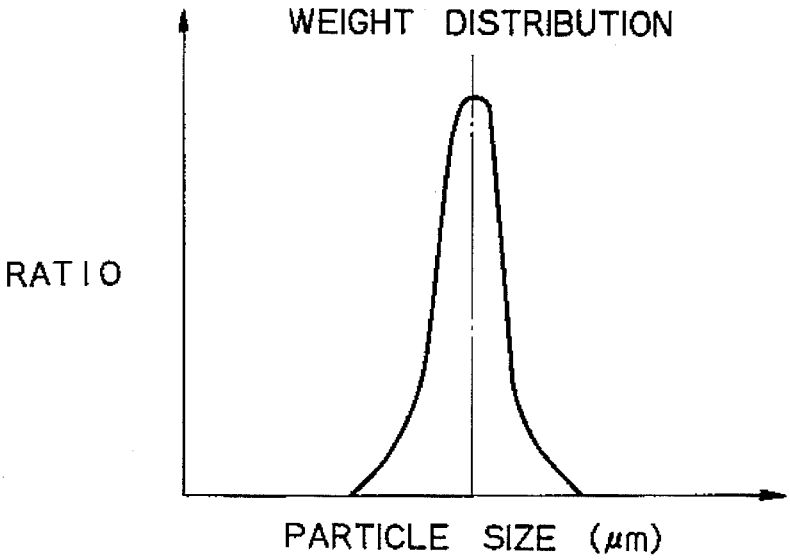
FIGS. 10A and 10B are graphs representative of the characteristic of a toner applied to the second developing unit shown in FIG. 3.
Figure 10B:
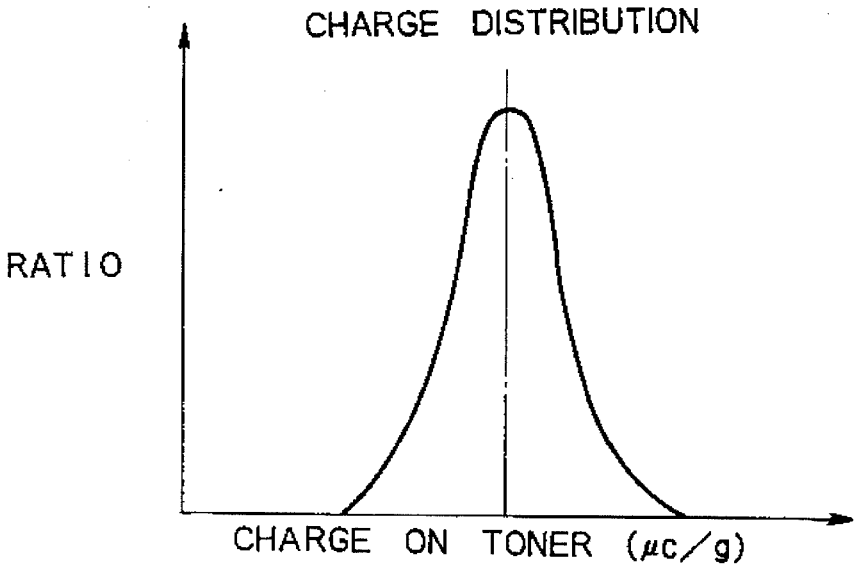
Figure 11A:
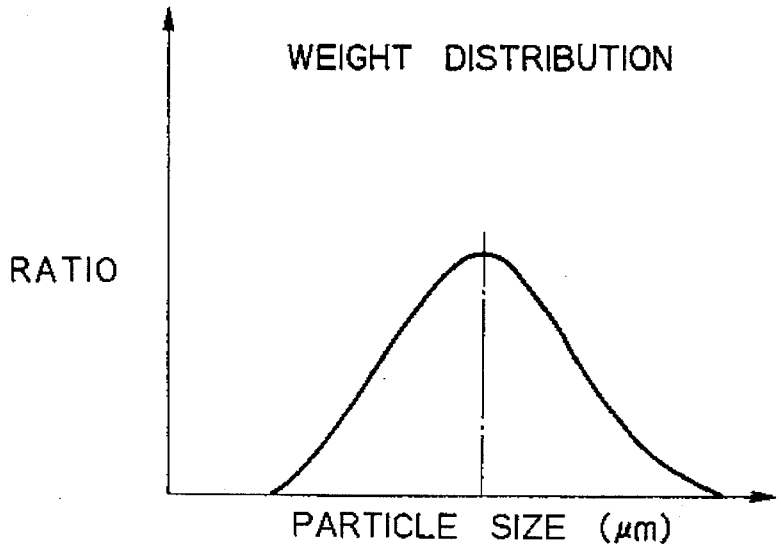
Fig. 11A PRIOR ART
FIGS. 11A and 11B are graphs representative of the characteristic of a conventional toner.
Figure 11B:
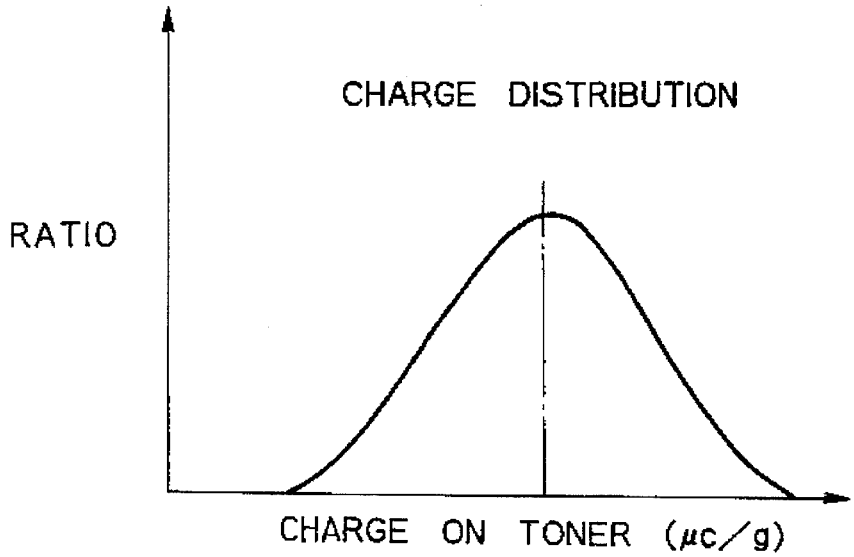
Fig. 11B PRIOR ART
Figure 12:
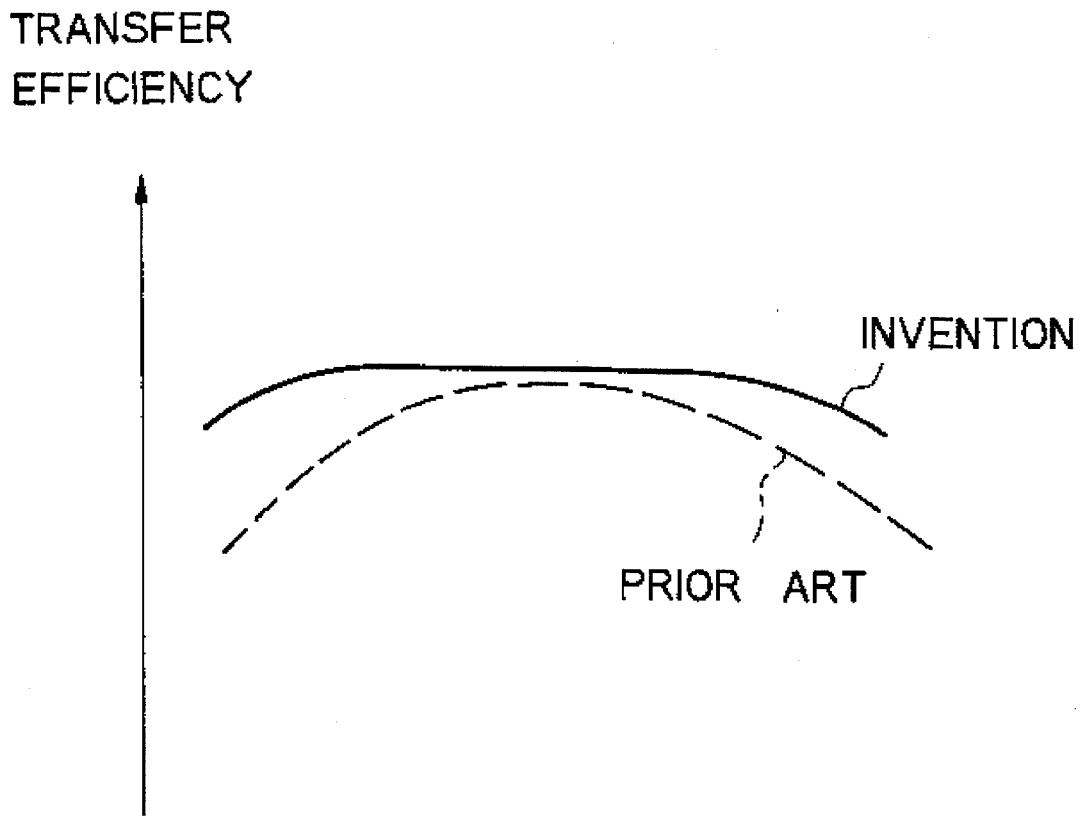
FIG. 12 plots the characteristic shown in FIGS. 10A and 10B and the characteristic shown in FIGS. 11A and 11B for comparison.

On the other hand, the toner of second color stored in the second developing unit 7 is constituted by spherical particles and, in addition, has a particle size distribution satisfying a ratio of average volume particle size to average number particle size which is smaller than or equal to 1.2. Specifically, since the second developing unit 7 uses a blade 23 for thinning the toner layer, the toner should preferably uniformly contact the blade 23 from the uniform charging standpoint. The uniform particle size distribution sets up a charge distribution shown in FIGS. 10A and 10B, thereby promoting uniform charging. FIGS. 11A and 11B are indicative of a charging characteristic particular to a conventional toner produced by pulverization and contrastive to the characteristic of the toner of second color stored in the second developing unit 7. When the secondary development is implemented with a DC bias, for example, the above-stated uniform charging allows the toner to be evenly transferred to the image carrier. In addition, the spherical toner particles contact the developing roller 21 over a minimum of area and are, therefore, not charged in a great amount when subjected to the bias for development. Such particles are easy to fly toward the image carrier, promoting efficient image transfer. Specifically, as shown in FIG. 12, the spherical toner particles are superior to the conventional pulverized toner particles in respect of the margin in the electric field for image transfer.

Various modifications will become possible for those skilled in the art after receiving the teachings of the present disclosure without departing from the scope thereof.

What is claimed is:

1. In a bicolor image forming method comprising the steps of: developing a first latent image which is electrostatically formed on an image carrier by a toner of first color, stored in a first developing unit, to thereby produce a toner image of first color; developing a second latent image electrostatically formed on said image carrier by a nonmagnetic one-component toner of second color, stored in a noncontact type second developing unit, to thereby produce a toner image of second color after the toner image of the first color is formed; and transferring the first and second toner images to a recording medium, the improvement wherein said toner of second color is deposited on a developing carrier of said second developing unit in a toner layer satisfying a relation:

$$\frac{dt^2}{\epsilon t} < 590\ (\mu m)^2$$

where dt is a thickness of the toner layer, and $\epsilon t$ is an average volume specific inductive capacity of the toner layer, and wherein the average volume specific inductive capacity $\epsilon t$ is equal to $(1-\alpha)+\alpha\epsilon$ where $\epsilon$ and $\alpha$ are a specific inductive capacity of said toner of second color and a packing ratio of the layer, respectively.

2. A method as claimed in claim 1, wherein said toner of second color has particles produced by polymerization and having an average volume particle size of 10 μm or less.

3. A bicolor image forming method comprising the steps of:

developing a first latent image for producing a toner image of first color by electrostatically forming the toner of first color in a developing unit on an image carrier;

developing a second latent image for producing a toner image of second color by electrostatically forming a nonmagnetic, one-component toner of the second color onto the image carrier after the first color is formed, the second color stored in a noncontact type second developing unit;

preventing the first color from flying off the image carrier due to a voltage potential difference between a voltage bias of the second color and a surface potential of the first latent image on the image carrier by first layering the toner of second color onto a developing carrier of the second developing unit with a thickness and then electrostatically attracting the toner of the second color onto the image carrier, the thickness of the toner of second color on the developing carrier satisfying a relation:

$$\frac{dt^2}{\epsilon t} < 590\ (\mu m)^2$$

where dt is the thickness of the layer, and $\epsilon t$ is an average volume specific inductive capacity of the layer, and wherein the average volume specific inductive capacity $\epsilon t$ is equal to $(1-\alpha)+\alpha\epsilon$ where $\epsilon$ and $\alpha$ are a specific inductive capacity of said toner of second color and a packing ratio of the layer, respectively; and transferring the first and second latent images from the image carrier to the recording medium.

4. A method according to claim 3, further comprising the steps of:

voltage biasing the toner of second color to a potential substantially equal to the surface potential of the toner of first color on the image carrier, such that the potential difference is less than 150 V.

5. A method according to claim 3, further comprising the steps of:

positioning the image carrier a distance between 0.05 mm and 0.5 mm from the developing carrier of the second developing unit.

6. The bicolor image forming method according to claim 3, further comprising the steps of:

maintaining a potential difference V between a bias voltage of the developing carrier of the second developing unit and an outermost layer of toner on the developing carrier of the second developer unit to be less than 50 V according to the relation:

$$V = \frac{\rho}{2\epsilon_0 \epsilon t}\ dt^2$$

wherein, $\rho$ is an average volume charge amount, $\epsilon_0$ is equal to $8.85\times10^{12}$ C/Vm, Q is a charge of the toner of second color, and P is equal to Q divided by the volume of the toner of second color;

setting a charge per unit mass Q/M of the toner of the second color on the developing carrier to be greater than 5 μC/g; and setting a mass per unit volume M/V greater than 0.3 g/cm$^3$, for providing attraction between the toner of second color on the developing carrier and the image carrier.

7. The bicolor image forming method according to claim 6, wherein the step of transferring the first and second latent images further comprises the steps of:

transferring the first latent image to the image carrier;

charging the image carrier to −800 V, a voltage of the first latent image elevated to at most −880 V;

exposing the image carrier to a photoelectric image for creating areas on the image carrier where the second latent image is to be formed, said areas where the second latent image is to be formed having a voltage of −100 V; and wherein said voltage of the toner of second color is maintained less than 50 V over a voltage of the developing carrier and a difference between potentials of the first and second latent images is not sufficient to cause the toner of first color to fly onto the image carrier.

8. The bicolor image forming method according to claim 1, wherein:

the toner of second color has particles produced by polymerization and having an average volume particle size of 10 μm or less;

the toner of second color is deposited in a plurality of layers;

the charge per unit mass is greater than 5 (μc/g); and the mass per unit volume is greater than 0.3 (g/cm$^2$).

9. A method for forming a multicolor image, comprising the steps of:

charging a photoconductive element;

exposing the photoconductive element to light to form a first latent image;

developing the first latent image using a first toner developer;

charging the photoconductive element;

exposing the photoconductive element to light to form a second latent image;

developing the second latent image using a second toner developer which forms a plurality of toner layers on a developing roller thereof, and transfers toner of the plurality of toner layers to the second latent image using an electrical attraction without the developing roller contacting the photoconductive element, wherein:

a difference in potential between a voltage of an outermost layer of the plurality of toner layers and a bias voltage of the developing roller is less than 150 volts;

a difference in potential between a voltage of a background section of the photoconductive element and the bias voltage of the developing roller is less than 150 volts; and the toner of the plurality of toner layers satisfying:

$$Q/M>5(\mu C/g)$$

$$M/V>0.3(g/cm^3)$$

$$V_{DIFF}=\frac{\rho}{2\epsilon_0\epsilon t}dy^2<50$$

Where Q/M is a charge per unit mass, M/V is an amount of toner per unit volume, $V_{DIFF}$ is a voltage difference between a bias voltage of the developing roller and a voltage of an outer most layer of toner on the developing roller, ρ is an average volume charge amount, $\epsilon_0=8.85\times10^{12}$ (C/V·m), $\epsilon t=(1-\alpha)+\alpha\epsilon$, where α is a packing ratio of toner on the developing roller, and dt is a thickness of toner on the developing roller.

* * * * *